US009303919B2

(12) United States Patent
Hultgren et al.

(10) Patent No.: US 9,303,919 B2
(45) Date of Patent: Apr. 5, 2016

(54) RADIO FREQUENCY DRYING OF HARVESTED MATERIAL

(71) Applicant: Dry Grain LLC, Raymond, MN (US)

(72) Inventors: Nathaniel L. Hultgren, Raymond, MN (US); Daniel C. Reek, Eden Prairie, MN (US); James Heine, Delano, MN (US)

(73) Assignee: Dry Grain LLC, Raymond, MN (US)

( * ) Notice: Subject to any disclaimer, the term of this patent is extended or adjusted under 35 U.S.C. 154(b) by 129 days.

(21) Appl. No.: 14/224,948

(22) Filed: Mar. 25, 2014

(65) Prior Publication Data

US 2014/0283406 A1 Sep. 25, 2014

Related U.S. Application Data

(60) Provisional application No. 61/804,946, filed on Mar. 25, 2013, provisional application No. 61/925,517, filed on Jan. 9, 2014.

(51) Int. Cl.
*F26B 9/00* (2006.01)
*F26B 3/28* (2006.01)
(Continued)

(52) U.S. Cl.
CPC ... *F26B 3/28* (2013.01); *F26B 3/34* (2013.01); *F26B 3/347* (2013.01); *F26B 9/063* (2013.01); *F26B 2200/06* (2013.01)

(58) Field of Classification Search
CPC ..... F26B 3/00; F26B 3/28; F26B 5/00; F26B 9/00; F26B 9/036; A61L 11/00; B09B 3/00
USPC ..... 34/255, 201, 210, 219; 219/679, 762, 219/770; 222/63, 52
See application file for complete search history.

(56) References Cited

U.S. PATENT DOCUMENTS 4,221,948 A 9/1980 Jean
5,105,563 A * 4/1992 Fingerson ..... A01D 43/003 34/203

(Continued)

FOREIGN PATENT DOCUMENTS

CA 2908062 A1 * 10/2014 ..... F26B 3/28
WO 9634240 A1 10/1996
WO WO 2014160721 A1 * 10/2014 ..... F26B 3/28

OTHER PUBLICATIONS

The International Search Report and the Written Opinion for International Application No. PCT/US2014/031752 mailed Jul. 17, 2014 (12 pages).

(Continued)

*Primary Examiner* — Stephen M Gravini
(74) *Attorney, Agent, or Firm* — Dicke, Billig & Czaja, PLLC

(57) ABSTRACT

One aspect is a material drying system with a conductive bin at least partially filled with harvested material. A frequency generator is configured to generate radio frequency energy and a controller is coupled to the frequency generator for controlling the radio frequency energy. At least one conductive shape located within the harvested material and coupled to the frequency generator and controller. The frequency generator and controller provide the radio frequency energy to the at least one conductive shape such that a system capacitor is formed by the combination of the at least one conductive shape and the conductive bin and with harvested material forming a dielectric therebetween such that friction of water molecules in the harvested material is induced quickening drying thereof.

12 Claims, 6 Drawing Sheets

(51) Int. Cl.

| | |
|---|---|
| ***F26B 3/34*** | (2006.01) |
| ***F26B 3/347*** | (2006.01) |
| ***F26B 9/06*** | (2006.01) |

(56) References Cited

U.S. PATENT DOCUMENTS

| | | | | | |
|---|---|---|---|---|---|
| 5,156,570 | A * | 10/1992 | Justice, III | A01D 41/133 | 34/180 |
| 5,420,404 | A | 5/1995 | Goodman et al. | | |
| 5,557,859 | A * | 9/1996 | Baron | F26B 3/286 | 34/102 |
| 5,950,325 | A | 9/1999 | Mehdizadeh et al. | | |
| 6,346,693 | B1 | 2/2002 | Kasevich | | |
| 6,638,475 | B1 | 10/2003 | Lagunas-Solar et al. | | |
| 6,807,750 | B1 * | 10/2004 | Lewis | F26B 17/101 | 19/66 CC |
| 7,856,737 | B2 * | 12/2010 | McMahon, Jr. | F26B 17/12 | 110/187 |
| 8,039,031 | B2 | 10/2011 | Baianu et al. | | |
| 8,046,877 | B2 * | 11/2011 | Nimmo | A01D 46/08 | 19/48 R |
| 8,875,412 | B1 * | 11/2014 | Anderson | F26B 9/063 | 165/177 |
| 9,027,257 | B1 * | 5/2015 | Harker | F26B 9/063 | 34/174 |
| 2010/0050392 | A1 * | 3/2010 | Nimmo | A01D 46/08 | 19/0.27 |
| 2014/0283406 | A1 * | 9/2014 | Hultgren | F26B 3/28 | 34/255 |
| 2014/0283407 | A1 * | 9/2014 | Hultgren | F26B 3/28 | 34/255 |
| 2015/0074948 | A1 * | 3/2015 | Nimmo, Sr. | A01D 46/08 | 19/0.27 |

OTHER PUBLICATIONS

Orsat, Valerie, "Radio-Frequency Thermal Treatments for Agri-Food Products," Department of Agricultural and Biosystems Engineering Macdonald Campus of McGill University, pp. 293 (1999).

Lagunas-Solar, Manuel C., "Radiofrequency Power: A New Physical, Non-Chemical Alternative Process for Food Sanitation," RF Biocidics, Inc., Technical Summary, pp. 1-39 (Jun. 2013).

* cited by examiner

RADIO FREQUENCY DRYING OF HARVESTED MATERIAL

This patent application is related to Ser. No. 14/224,971, filed on Mar. 25, 2014, entitled "RADIO FREQUENCY DRYING OF HARVESTED MATERIAL" and which is incorporated herein by reference.

CROSS REFERENCE TO RELATED APPLICATIONS

This Non-Provisional patent application claims the benefit of the filing date of U.S. Provisional Patent Application Ser. No. 61/804,946, filed Mar. 25, 2013, entitled "RADIO FREQUENCY GRAIN DRYING," and of the filing date of U.S. Provisional Patent Application Ser. No. 61/925,517, filed Jan. 9, 2014, entitled "RADIO FREQUENCY GRAIN DRYING," each of which are herein incorporated by reference.

BACKGROUND

Documented methods for the preservation and storage of harvested material, such as corn and grains, include non-assisted air drying, conductive heat air drying, electromagnetic and radiant heat drying powered by electricity, petroleum, natural gas or propane. The drying processes may be continuous flow or batch drying. Although it will vary depending on the type of harvested material, some harvested material, such as corn, is preserved at moisture contents below 13% and stored in large steel and concrete structures until utilized in feed and food production. Difficulties with current methods include short harvesting seasons, rapid field harvesting equipment, slow and inefficient handling and drying methods, unstable fuel supplies and direct exposure of eatable materials to combustion emissions.

Previously proposed electromagnetic drying methods use a concrete structure and antennas emitting radio frequency (RF) energy in standing waves directed by input energy levels or physical orientation of the antennas. In many such systems, the emitted RF waves cannot be not safely controlled. As such, the exterior installation of equipment is not plausible. Some such systems suffer from inefficiencies, particularly for partially filled holding containers. For these and other reasons, there is a need for the present invention.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1:
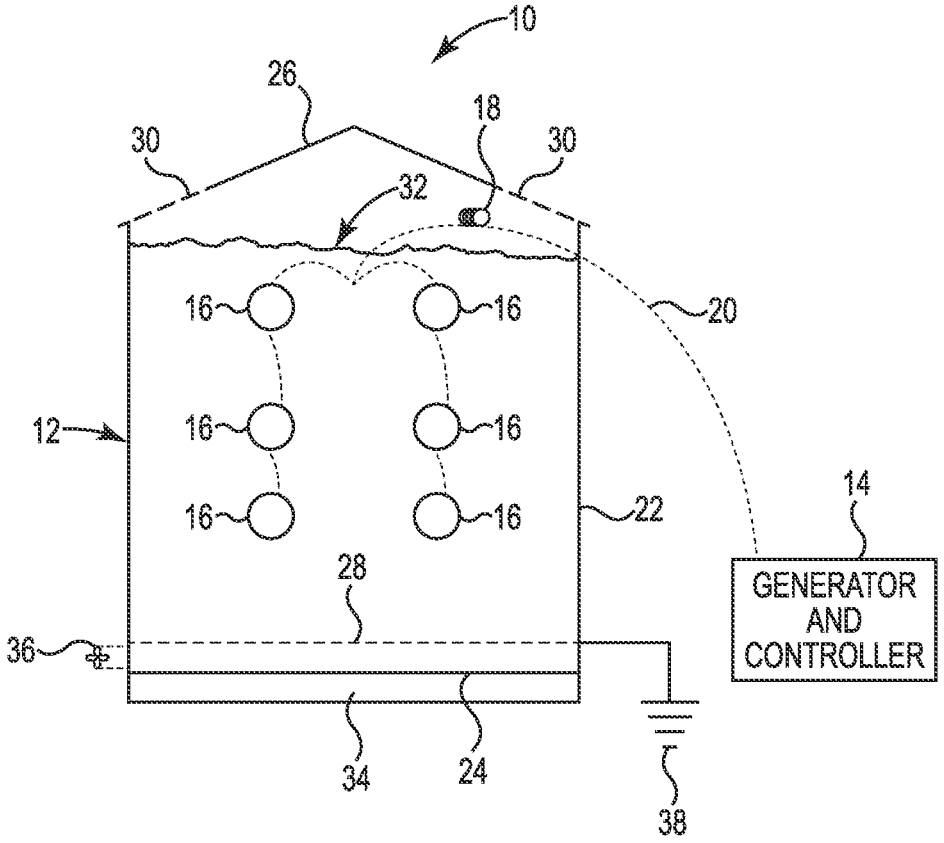
FIG. 1 is a cross-sectional view of a material drying system in accordance with one embodiment.

FIG. 1 illustrates a material drying system 10 in accordance with one embodiment. Material drying system 10 includes bin 12, generator and controller 14, metal conductive shapes 16 and conductive shape controller 18. Generator and controller 14 is coupled to metal conductive shapes 16 and conductive shape controller 18 via transmission line 20.

In one embodiment, bin 12 includes generally cylindrical walls 22 having a bottom 24 and a top 26. Bin 12 may be further provided with a perforated floor 28, just above its bottom 24, which allows the passage of air into bin 12, as will be discussed more fully below. Similarly, top 26 may be provided with perforated sections 30, which also allow the passage of air relative to bin 12. In one embodiment, bin 12 is made completely of metal and is configured to rest on a secure foundation 34, such as a concrete slab. Bin 12 may be further electrically coupled to earth ground 38.

In operation, bin 12 is filled with harvested material 32. In various embodiments, harvested material 32 may be corn, rice, grains, soybeans, nuts or other harvested plant material. In most instances, harvested material 32 will have a higher moisture content after harvesting than is desired for safe storage. Higher moisture contents for harvested material 32 during storage generally leads to rapid deterioration of material 32, leading to mold, spoilage and even development of toxins. Accordingly, material drying system 10 is configured to help speed the drying of harvested material 32, as well as reduce the energy used in drying thereby improving drying efficiency.

Placement and removal of harvested material 32 can be accomplished with commercially available filling elevators, lifts, and augers. Although material drying system 10 can be utilized to dry an entirely full bin 12, the system 10 can accommodate varying filling situations, including daily harvesting and harvesting delays such as wet weather. Drying can be accomplished in layers of harvested material 32 as little as five feet deep, or in several layers of, for example, five foot increments, or with harvested material 32 substantially filling bin 12.

In one embodiment, bin 12 is a commercially available galvanized steel grain bin. Bin 12 is structurally sound, weather tight and built on solid foundation 34, such as a concrete slab. Material drying system 10 can utilize existing bin structures or may be used in conjunction with a new bin construction. Perforated floor 28 raised above foundation 34 creates a plenum for distribution of forced air from fan 36. In one embodiment, perforated floor 28 is also metallic, is electrically connected to the bin walls 22, and is capable of supporting heavy loads imparted by harvested material 32.

In one embodiment, fan 36 is configured to provide warm air to the lower portion of bin 12, and specifically, below perforated floor 28, such that the warm air flows up through harvested material 32 and moisture is carried out perforated sections 30 in top 26. Although moving warm air through harvested material 32 via fan 36 without any further system components can effectively dry harvested material 32, there are high costs associated with providing the warmed air, and it takes a significant amount of time to reach the desired moisture content for the harvested material 32.

Accordingly, as illustrated in FIG. 1, conductive shapes 16 are discrete components that are distributed throughout harvested material 32 that is stored in bin 12. Generator and controller 14 transfers RF energy to the conductive shapes 16 via transmission line 20. Transmission line 20 can be coaxial cable, waveguide or similar transmission medium. Once energized, conductive shapes 16 and bin 12 form an effective system capacitor, with the metal of bin 12 forming one side of the capacitor, the metal of conductive shapes 16 forming another side of the capacitor, and the harvested material 32 forming the dielectric material therebetween. This effective system capacitor quickens drying time (shortens the amount of time needed for drying) and increases overall energy efficiency in drying. This allows for less amounts of warmed air to be used, or even avoid the use of warmed air in some embodiments, all increasing energy efficiency in drying.

With this configuration of material drying system 10, including harvested material 32 acting as the dielectric in an effective system capacitor, dielectric induced friction of water molecules within harvested material 32 generates internal energy in moist cells and fluids. The energy quickens the state of natural drying of the harvested material 32, which releases excess moisture prior to normal air/cell equilibrium. Material drying system 10 more efficiently and more quickly dries harvested material 32 to an appropriate moisture content for safe storage of harvested material 32.

RF energy spins water molecules against cell walls of the harvested material 32 producing friction which then produces heat energy to evaporate moisture from the material. Rather than simply heat the air surrounding the harvested material 32, material drying system 10 transmits RF energy directly into the harvested material 32. For example, when harvested material 32 is corn, RF energy is transmitted directly into the corn kernel, stimulating the moisture in the kernel to evaporate from the inside the kernel to the outside of the kernel. Energy is not wasted on heating the air, but rather heats the kernel itself to evaporate the moisture. In one embodiment, this requires at least 50% less energy to dry the corn. The associated energy savings also means greenhouse and non-greenhouse gas emissions are reduced by a similar percentage.

Furthermore, the lower drying temperatures are gentler on the harvested material 32, resulting in a better quality end product. The drying itself is more consistent and easier to gauge than with conventional grain dryers, which results in better control of the drying process and a more consistent end product (across the bin and within the kernel itself). The RF energy used in material drying system 10 is a safe drying process requiring no combustion and with no harmful emissions exhausted.

In one embodiment, cylindrical walls 22, bottom 24 and a top 26 of bin 12 are metallic and all cooperate to fully contain the RF energy supplied to conductive shapes 16 by generator and controller 14. Because significant amounts of RF energy can be dangerous to living animals, bin 12 is configured to substantially contain the RF energy such that it does not transmit beyond bin 12. Both perforated floor 28 in bottom 24 and perforated sections 30 in top 26 are configured such that RF energy is not able to transmit through them.

Figure 2:
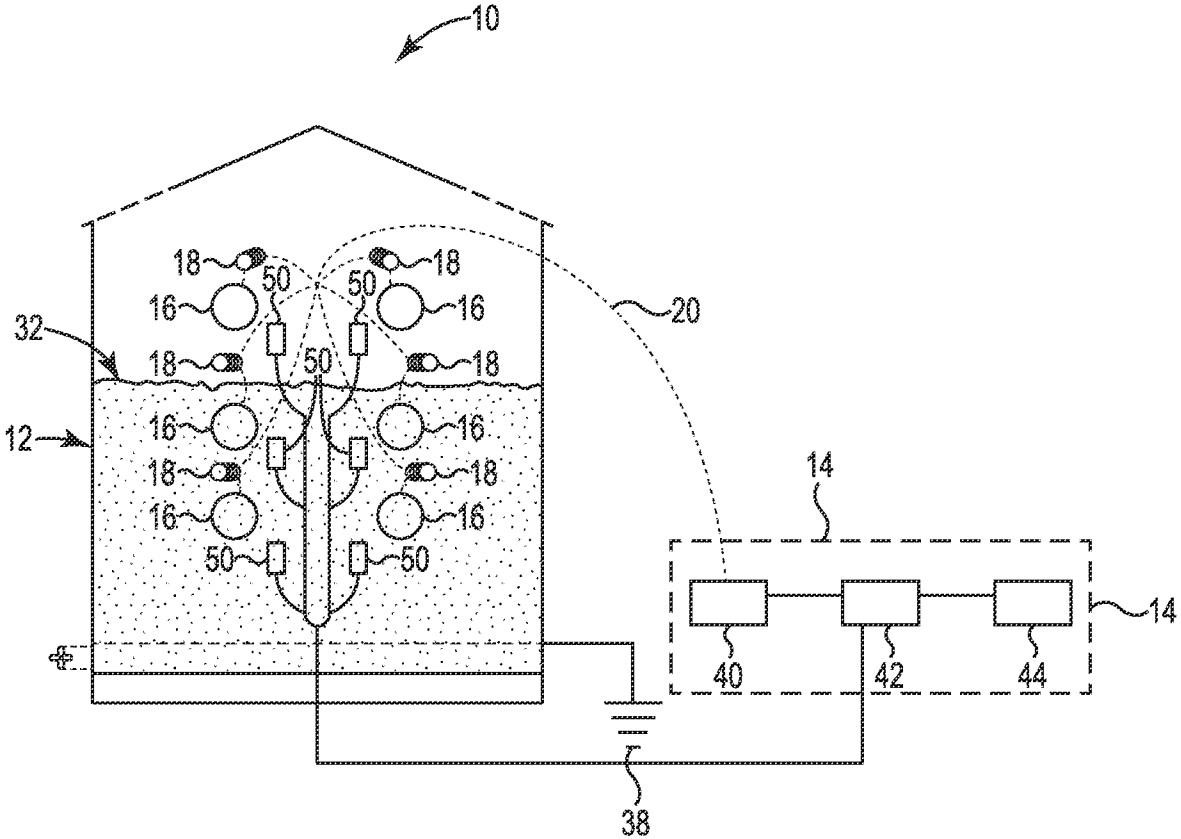
FIG. 2 is a cross-sectional view of additional detail of a material drying system in accordance with one embodiment.

FIG. 2 illustrates additional detail of material drying system 10 in accordance with one embodiment. Generator and controller 14 includes frequency generator 40, main control module 42, and power source 44. In one embodiment, frequency generator 40 is a commercially-available RF generator. In one embodiment, frequency generator 40 operates at 13.56 M Hz to 27.12 M Hz and generates continuous sinusoidal waves. In other embodiments, a full range of RF energy from 3 kHz to 300 GHz can be provided. In one embodiment, frequency generator 40 ranges in size from 2,000 to 20,000 watts. A very large drying facility may use larger or multiple RF generators, whereas smaller applications may only use a single generator.

Power source 44 can be any of a variety of sources of energy used to power drying system 10. In one embodiment, power source 44 is a permanent alternating current (ac) power source or a commercially available ac generator. In other embodiments, solar, hydro-electric and/or wind generated electricity supplies can supplement more conventional sources to assure that consistent power is provided. In one embodiment, consistent power is beneficial in wet harvest situations where significant drying will be needed.

Main control module 42 can be automated, manual, or remote. In one embodiment, control module is a microprocessor-based computer. Manual installations may include operator personnel that are physically present, at least at periodic times, for example for hourly adjustments. Even in some automated system installations, daily or hourly observation and verification may be useful. Remote controls and/or internet-based access to controls allow distant monitoring, controls and alarms with daily adjustments.

Frequency generator 40 transmits RF energy to the conductive shapes 16 on one side of the system capacitor via transmission line 20. Transmission line 20 transmits electromagnetic waves to conductive shapes 16, but not to harvested material 32. The other side of the system capacitor, bin 12, is coupled to earth ground 38.

In one embodiment, a conductive shape controller 18 is provided coupled to each of conductive shapes 16 (in other embodiments, one or more conductive shapes 16 can share conductive shape controllers 18). Furthermore, sensors 50 are provided relatively proximate to each of conductive shapes 16. In one embodiment, sensors 50 can detect moisture, temperature, RF energy penetration and related conditions of the harvested material 32 in the proximity of conductive shapes 16. This measured information is relayed back to main control module 42 such that adjustments may be made based on sensed conditions.

In one embodiment, conductive shape controller 18 includes adjustable capacitors and/or inductors that are controlled by main control module 42 that can be adjusted based on the measured feedback received from sensors 50. In one example, an adjustable capacitor or an adjustable inductor on conductive shape controller 18 is tuned to achieve resonant conditions relative to bin 12, conductive shapes 16, and harvested material 32. As discussed, bin 12, conductive shapes 16, and harvested material 32 together form a system capacitor in drying system 10. As such, adjustable capacitor or an adjustable inductor on conductive shape controller 18 can be adjusted to match the capacitance and/or inductance of the system capacitor of bin 12/shapes 16/material 32. In this way, the molecular activity in moisture of the harvested material 32 is optimized.

Main control module 42 and conductive shape controller 18 electronically adjust the adjustable capacitor and/or adjustable inductor on conductive shape controller 18 to account for the level of moisture in harvested material 32 and its effect on capacitance. At resonance, material drying system 10 provides resonant, efficient energy to conductive shapes 16, which act as a capacitive object with bin 12, inducing dielectric movement of the water molecules in harvested material 32 and on the surface of the harvested material 32. Activity increases the rate of evaporation from the surface by increasing the probability that any water molecule will vaporize and be suspended as a gas in the air. The increase evaporation rate increases the water diffusion rate from the center to the surface of harvested material 32. Harvested material 32 energized this way dries more quickly than material that is not energized, and also has less need for warmed air in many applications.

In one embodiment, conductive shapes 16 are metallic orbs. For example, each of conductive shapes 16 can be hollow spheres that are made of metal having a diameter of approximately 12 inches. Each of the metal orbs can be distributed about the interior of bin 12 within the harvested material 32 such that each can be configured to affect different areas of harvested material 32 contained within bin 12. As such, where moisture content varies throughout harvested material 32 in bin 12, main control module 42 and conductive shape controller 18 can tune capacitance or inductance based on the sensed measurements that were taken via a sensor 50, which is adjacent to a particular conductive shape 16. In this way, capacitance or inductance at conductive shape controller 18 associated with shape 16 can have a custom adjustment based on moisture content and other measured conditions at that location, in order to obtain and maintain resonance.

In addition, bin 12 can be used in a variety of ways consistent with material drying system 10. Bin 12 may be used as an "in-bin" drying and storage container in which harvested material 32 is both dried and stored. In one such embodiment, harvested material 32 may be filled near the capacity of bin 12, such as illustrated in FIG. 1. In such case, it may be useful to employ a plurality of conductive shapes 16 distributed throughout the harvested material 32, each of which can be customized depending on measured conditions proximate thereto.

In other cases, harvested material 32 can be dried in "layers," such that a limited amount is added to bin 12, for example five to seven feet of material, such that only a couple or even only one conductive shape 16 is used in drying. Then, once the first layer is dried, a second layer may be added. In the subsequent added layer, a different conductive shape 16 that is located within the second added layer can be used, or the same conductive shape 16 used in drying the first layer can be used by lifting the conductive shape 16 (either with an automatic mechanism or manually) from the first layer up to the second layer so that the second added layer can then be energized and dried.

Also, similar to "in-bin" harvested material 32 can be dried with "batch drying." In such case, bin 12 is used as to dry harvested material 32. Once the entire bin of harvested material 32 is dried, it can then be moved to other locations for storage.

In still other cases, bin 12 may be configured as a "continuous flow" drying container, such that harvested material 32 is continually added, then dried, and continually removed for storage in another location by a sweep system. Such continuous flow system will be more fully discussed below.

Figure 3:
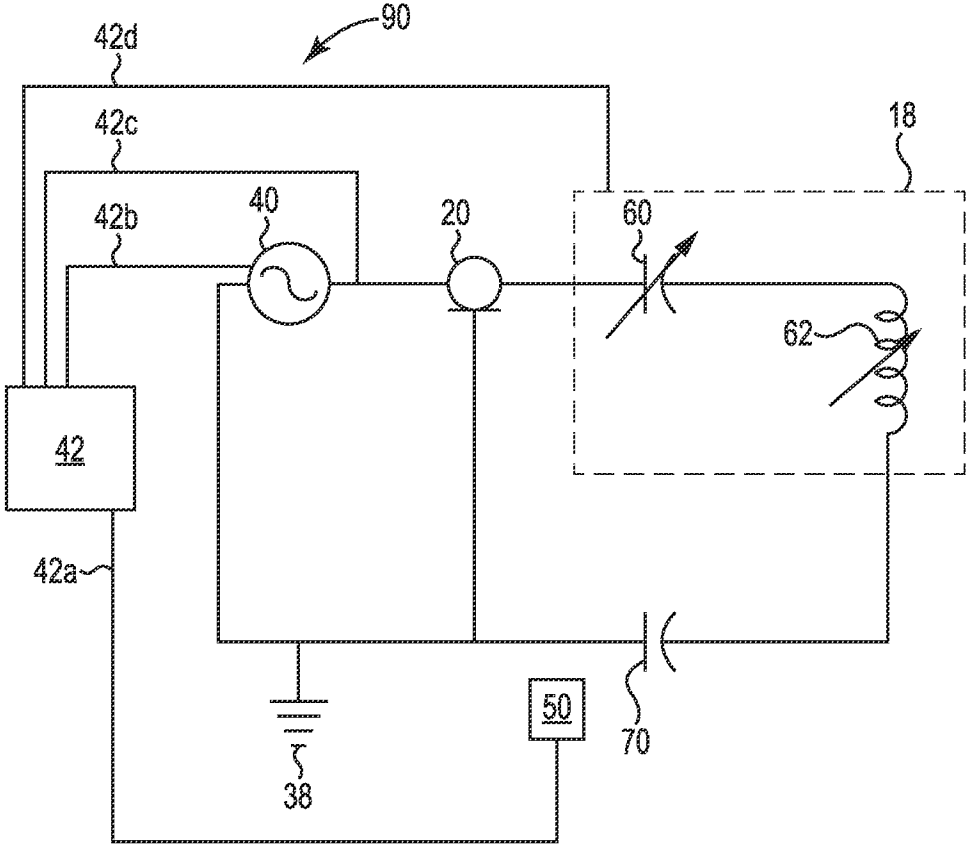
FIG. 3 is an equivalent circuit representing a material drying system in accordance with one embodiment.

FIG. 3 illustrates a schematic equivalent circuit 90 for material drying system 10 in accordance with one embodiment. Equivalent circuit 90 for material drying system 10 includes frequency generator 40, transmission line 20, conductive shape controller 18, and equivalent bin capacitance 70. Conductive shape controller 18 includes adjustable capacitor 60 and adjustable inductor 62. In one embodiment, equivalent bin capacitance 70 is representative of the capacitive value of the combination of metal bin 12, conductive shapes 16 and harvested material 32 acting as the dielectric therebetween.

Equivalent circuit 90 further includes main control module 42 configured to control frequency generator 40 and conductive shape controller 18 via control lines 42*b* and 42*d*, respectively. Main control module 42 is also configured to receive sensed signals from sensor 50, which is located proximate to equivalent bin capacitance 70, via control line 42*a*. Main control module 42 is also configured to monitor transmission line 20 to monitor reflected power.

Accordingly, in one embodiment, main control module 42 controls RF generator 40 to provide RF energy in continuous sinusoidal waves within equivalent circuit 90. Main control module 42 then monitors power reflected back and adjusts one or both of adjustable capacitor 60 and adjustable inductor 62 in order to minimize reflected power such that equivalent circuit 90 achieves resonance and operates at maximum efficiency.

Figure 4:
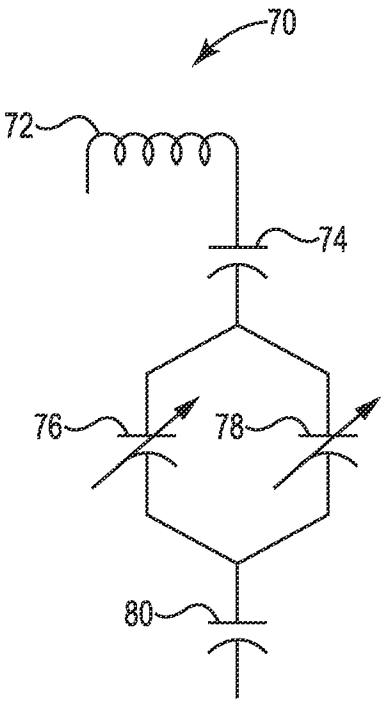
FIG. 4 is an equivalent circuit representing an effective system capacitor of a material drying system in accordance with one embodiment.

FIG. 4 illustrates schematic equivalent bin capacitance 70 in accordance with one embodiment. In one embodiment, equivalent bin capacitance 70 includes inductance 72, first capacitance 74, second capacitance 80, first variable capacitance 76, and second variable capacitance 78. In one example, these components of equivalent bin capacitance 70 approximate the properties of metal bin 12, conductive shapes 16 and harvested material 32 acting as the dielectric therebetween. In one example, inductance 72, first capacitance 74, and second capacitance 80 are representative of bin 12 and conductive shape 16. The values will be in proportion to the dimensions of these items.

Since the moisture content harvested material 32 is variable depending on harvesting and weather conditions, including rain, wind, temperature and time between harvesting and delivery to bin 12, harvested material 32 acting as the dielectric will also be variable. Accordingly, first variable capacitance 76 is representative of the harvested material 32 as a dielectric and second variable capacitance 78 is representative of the air between harvested material 32 as a dielectric. The amount of air between harvested material 32 will vary depending on what type of material it is, such as grains, corn, soybeans, rice, nuts or other materials. Harvested material in kernel form, such as corn will have more air, whereas finer materials will have less. Furthermore, when harvested material is corn still on the cob, there will be more air than there will be when the material is kernels that have been removed from the cob.

Accordingly, main control module 42 monitors a variety of sensed conditions at sensor 50, including humidity and temperature of harvested material 32, in order to further make adjustments to adjustable capacitor 60 and/or adjustable inductor 62 in order to maintain resonance of equivalent circuit 90. In addition, main control module 42 monitors power at sensor 50 in order to determine power penetration of the RF energy into the harvested material 32. In one embodiment, it is important that the sinusoidal waves of RF energy from frequency generator 40 does not establish a standing wave in harvested material 32. By monitoring power penetration at sensor 50, main control module 42 can make adjustments to frequency generator 40 and/or adjustable capacitor 60 and adjustable inductor 62 to ensure that no standing wave is established in harvested material 32.

In one embodiment, conductive shape controller 18 includes lumped element baluns capable of adjusting the electronic components to provide adjustable capacitive and inductive resonance for bin 12 and harvested material 32. Conductive shape controller 18 includes circuits designed to utilize continuous sinusoidal waves from frequency generator 40. In one embodiment, conductive shapes 16 are highly conductive metal orbs suspended in harvested material 32. Upon filling bin 12 with harvested material 32, conductive shapes 16 are surrounded by harvested material 32. Conductive shapes 16 are restricted in size and shape to prevent standing electromagnetic waves and inefficient antenna phenomena. In one example, conductive shapes 16 are highly conductive metal orbs having a diameter of 12 inches.

In one embodiment, additional sensors are provided adjacent to perforated floor 28 and/or perforated sections 30 of top 26 such that air leaving the bin 12 is monitored the temperature, moisture and relative humidity. Main control module 42 can then adjust fan 36 and or the amount of heat provided to bin 12 according to measured evaporation rates within harvested material 32, providing minimum air flow rates to remove the moisture from the system and maximizing efficiency. For example, on some embodiment, it may be most efficient to dry harvested material 32 only by energizing with RF energy and not using heated air, such that fan 36 is disabled or limited is duration or in speed.

Figure 5:
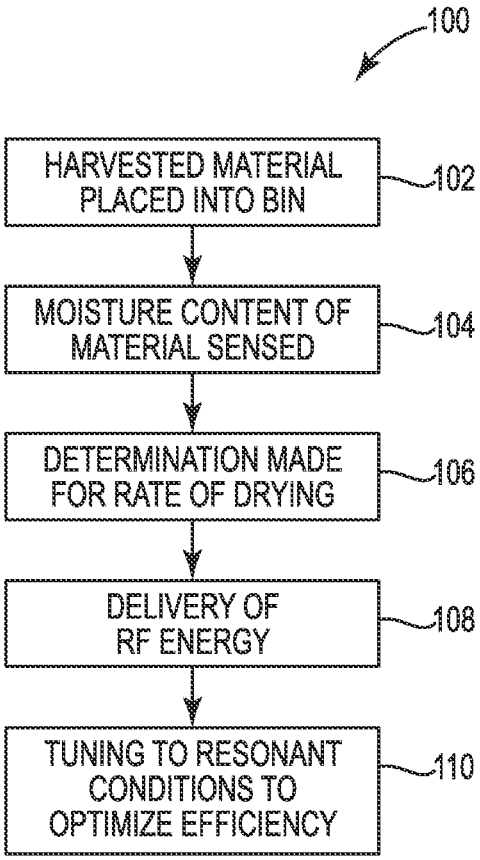
FIG. 5 is a flow diagram illustrating a method of drying material in accordance with one embodiment.

FIG. 5 illustrates a method 100 of drying material using a material drying system 10. At step 102 commercially available harvesting and handling equipment, operating at the desired harvesting, transport and storage receiving rates, are used to place harvested material 32 into bin 12—either in partial filling layers (for example, FIG. 2) or complete filling (For example, FIG. 1). The harvested material may have moisture contents which would induce spoilage in as little as three days. In one example, harvested material may include corn, and typical harvested moisture contents for corn typically fall in the range from 12% to 30% moisture content, and dry material from 10% to 13% moisture content.

At step 104, main control module 42 senses the moisture content of the harvested material and determines whether moisture content is above desired levels. If moisture content is above desired levels, main control module 42 determines how far above.

At step 106, a rate of drying is determined that will be sufficient to dry the harvested material before spoilage. In order to determine the rate of drying, main control module 42 monitors the moisture content and temperature of the harvested material in bin 12, monitors air relative humidity and temperature outside bin 12, and can monitor air relative humidity and temperature as it is exiting bin 12.

In one example, the drying rate is adjusted based on the following factors: 1) the dryness and temperature of the air entering the system, 2) the moisture removal needed in the grain and 3) the anticipated upcoming weather. For example, if the weather calls for a foggy night, the fans should not run (since that would drive more humidity into the bin), but the RF would run. If it was going to rain for two days, the fan would not run for 2 days and the RF might run, then on the following non-rain days, the fan and RF would run.

In one embodiment, main control module 42 determines the required power level and rate of air flow required to energize and remove the moisture. In one embodiment, the design and equipment raise the energy level in the moisture which is evident by raising the temperature of the harvested material by five to 25 degrees F. The temperature of the harvested material is affected by air speed evaporation rates and may drop by upwards of 10 degrees F. during efficient operation. In some embodiments, for example where the outside air temperature is very low, for example 0 degrees F., the temperature of the harvested material may increase by as much as 70 degrees F. or more. Monitoring the interior of bin 12 is comparable with conventional weather terms such as dry bulb temperature, wet bulb temperature, relative humidity and dew point, and can be optimized with mechanical engineering standard calculations.

At step 108, main control module 42 enables frequency generator 40 such that a continuous sinusoidal waveform of RF energy is delivered via transmission line 20 to conductive shapes 16.

At step 110, main control module 42 tunes conductive shape controller 18 to resonant conditions thereby optimizing the molecular activity in the moisture of the harvested material. Adjustable capacitors and/or inductors of conductive shape controller 18 are electronically adjusted to the capacitance of the moist harvested material. At resonance, frequency generator 40 provides resonant, efficient energy to conductive shapes 16, which act as capacitive objects with the metal bin 12, inducing dielectric movement of the water molecules in the harvested material. Where the harvested materials are kernels, such as grain kernels, the induced dielectric movement of the water molecules will be both in the grain kernel and on the surface of the kernel. Activity increases the rate of evaporation from the surface by increasing the probability that any water molecule will vaporize and be suspended as a gas in the air. The increase evaporation rate increases the water diffusion rate from the center to the surface of the kernel.

In one example, a material drying system 10 includes a bin 12 that is a 21 foot diameter metal bin with an eight feet deep layer of corn. Embedded within the corn layer is a conductive shape 16, which is a ten inch diameter metallic orb. In this example, grain bin 12 capacitance ranged from 65 to 300 picofarads (pF) with an inductance of 8 to 50 millihenries (mH).

Once the evaporation process is initiated at the desired drying rate, main control module 42 cycles through a sequence of momentarily lowering the RF wattage by controlling frequency generator 40, samples the temperature and humidity sensors, calculates the moisture content of the corn, balances the evaporation and moist air removal rates, and adjusting the capacitance and/or inductance on conductive shape controller 18 to assure resonance. In one example, this optimization process occurs one to 3 times per hour and will adapt the system to changing weather conditions.

Material drying system 10 is self-balanced in that system 10 takes advantage of the fact that minor deviations to the moisture content of the harvested material 32 causes differentiation in drying. Drier grain has a lower dielectric constant and thus not drying as quickly as areas in the grain with higher moisture content, which would be in higher resonance with the system.

In one experiment, energy flux calculations and physical experimentation indicated that a 12-inch diameter orb can effectively dissipate 2,000 watts at a radius of 10 feet. Multiple orbs may be installed, and in this case, 20-foot spacings were used between each of the distributed orbs so that there was not significant overlap in the dissipated radius of each orb. In such case, the distributed orbs can be connected to a single or to multiple RF generators. Orbs having a larger diameter effectively dissipate more energy in a linear relationship, and are limited by the electronic capacity and size limit of conductive shape controller 18 introduced when the increased size dominates the ability to establish resonance with the grain's dielectric constant.

When grain in the layer or area of conductive shape 16 reaches the desired moisture content, 13% moisture content typically, main control module 42 uses the electronic relays to disconnect the electrical circuit to that area and connects to the next moist layer or area. The system performs initial monitoring on the new area and begins the drying cycle.

Once the entire grain supply is dried as desired, main control module 42 may be turned off and if desired, disconnected and moved to a different bin with a different distribution system and set of conductive shapes 16.

At that point, the grain can be stored in the bin or handled as desired. Structurally, the invention's support inside the bin should accommodate grain shrinkage during drying and additional loads experienced by filling and empting the bin. If the structural installation interferes with the bin's emptying equipment and floor sweeps, the design should accommodate a temporary disconnect from the floor.

Figure 6:
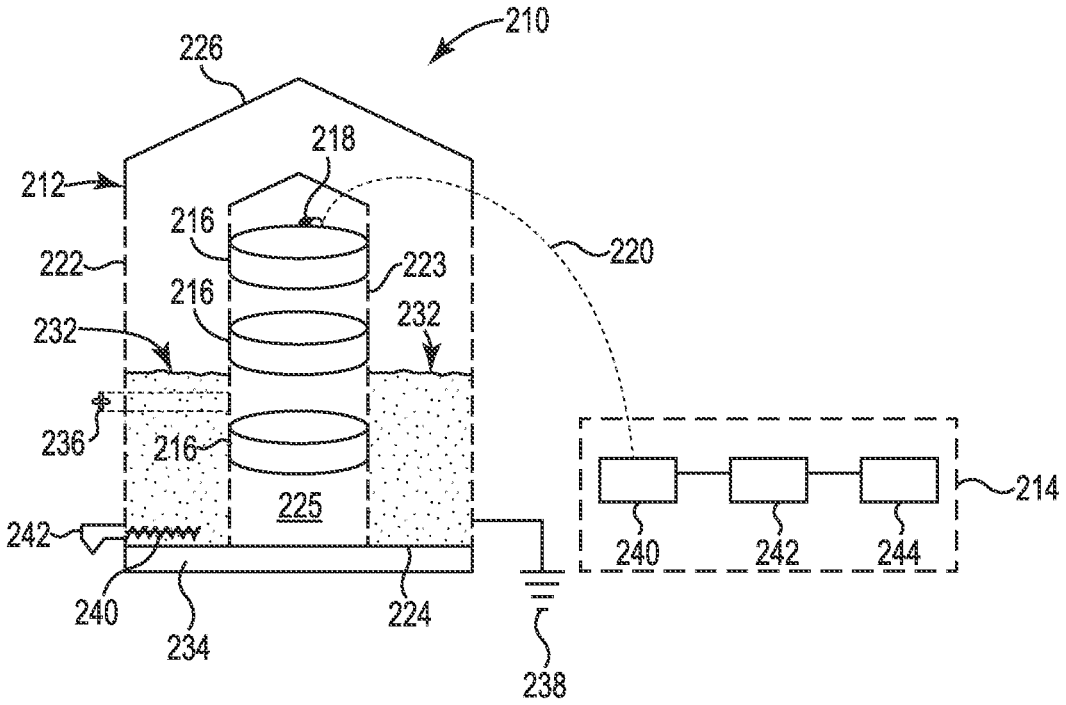
FIG. 6 is a cross-sectional view of a material drying system in accordance with one embodiment.

FIG. 6 illustrates a material drying system 210 in accordance with one embodiment. Material drying system 210 includes bin 212, generator and controller 214, metal conductive shapes 216 and conductive shape controller 218. Generator and controller 214 is coupled to metal conductive shapes 216 and conductive shape controller 218 via transmission line 220. Generator and controller 214 includes frequency generator 240, main control module 242, and power source 244.

In one embodiment, bin 212 includes generally cylindrical walls 222 and has a bottom 224 and a top 226. As illustrated, cylindrical walls 222 of bin 212 are perforated, which allows the passage of air out of bin 212. Bin 212 is further configured with inner cavity walls 223, which are also generally cylindrical walls that are perforated. Accordingly, inner cavity walls 223 establish inner cavity into which metal conductive shapes 216 can be provided and force air can be introduced, as will be discussed further below. In one embodiment, bin 212 is made completely of metal and is configured to rest on a secure foundation 234, such as a concrete slab. Bin 212 may be further electrically coupled to earth ground 238.

Similar to bin 12 described above, bin 212 is in various embodiments configured to dry a variety of harvested material 232, which may be corn, rice, grains, soybeans, nuts or other harvested plant material. In operation, bin 212 is filled with harvested material 232 between inner cavity walls 223 and cylindrical walls 222. In one embodiment, bin 212 is configured as a continuous-fill bin in that, rather than storing harvested material 232 after it is dried, mechanical sweep 240 is configured to remove the dried harvested material 232 out unloading output 242. As such, harvested material 232 can be loaded into bin 212, dried, and then removed via unloading output 242 in order to make room for additional material that can be added in continuous fashion.

In one embodiment, conductive shapes 216 are mounted within inner cavity walls 223 such that they are distributed throughout harvested material 232 that is added to bin 212. In the illustrated embodiment, conductive shapes 216 are metallic cylindrical rings that surround cavity 225. Generator and controller 214 transfers RF energy to the conductive shapes 216 via transmission line 220. Once energized, conductive shapes 216 and bin 212 form an effective system capacitor, with the metal of bin 212 forming one side of the capacitor, the metal of conductive shapes 216 forming another side of the capacitor, and the harvested material 232 forming the dielectric material therebetween. This effective system capacitor quickens drying and increases overall energy efficiency in drying.

In one embodiment, as with the system 10 described above, conductive shape controller 218 includes adjustable capacitors and/or inductors that are controlled by main control module 242 that can be adjusted based on the measured feedback received from sensors (for example, sensors 50 illustrated in FIG. 2). In one example, an adjustable capacitor or an adjustable inductor on conductive shape controller 218 is tuned to achieve resonant conditions relative to bin 212, conductive shapes 216, and harvested material 232. Since the moisture content of harvested material 232 varies, the capacitance of the system capacitor formed from bin 212, conductive shapes 216, and harvested material 232 varies accordingly. Main control module 242 and conductive shape controller 218 electronically adjust the adjustable capacitor or adjustable inductor on conductive shape controller 218 to account for the level of moisture in harvested material 232 and its effect on capacitance.

As such, capacitance and inductance is matched in order to achieve resonance. At resonance, material drying system 210 provides resonant, efficient energy to conductive shapes 216, which act as a capacitive object with bin 212 inducing dielectric movement of the water molecules in harvested material 232 and on the surface of the harvested material 232. This activity increases the rate of evaporation from the surface and increases the water diffusion rate from the center to the surface of harvested material 232.

In one embodiment, conductive shapes 216 are metallic cylindrical rings. For example, each of conductive shapes 216 can be cylindrical rings that are made of metal having a height of approximately 12 inches. Each of the metal cylindrical rings are discrete components that can be distributed about the interior of bin 212 such that each can be configured to affect different areas of harvested material 232 contained within bin 212. As such, where moisture content varies throughout harvested material 232 in bin 212, main control module 242 and conductive shape controller 218 can tune capacitance or inductance based on the sensed measurements that were taken via a sensor that is adjacent to a particular conductive shape 216 (for example, sensors 50 in FIG. 2). In this way, capacitance or inductance at conductive shape controller 218 associated with shape 216 can have a custom adjustment based on moisture content and other measured conditions, in order to obtain and maintain resonance.

Figure 7:
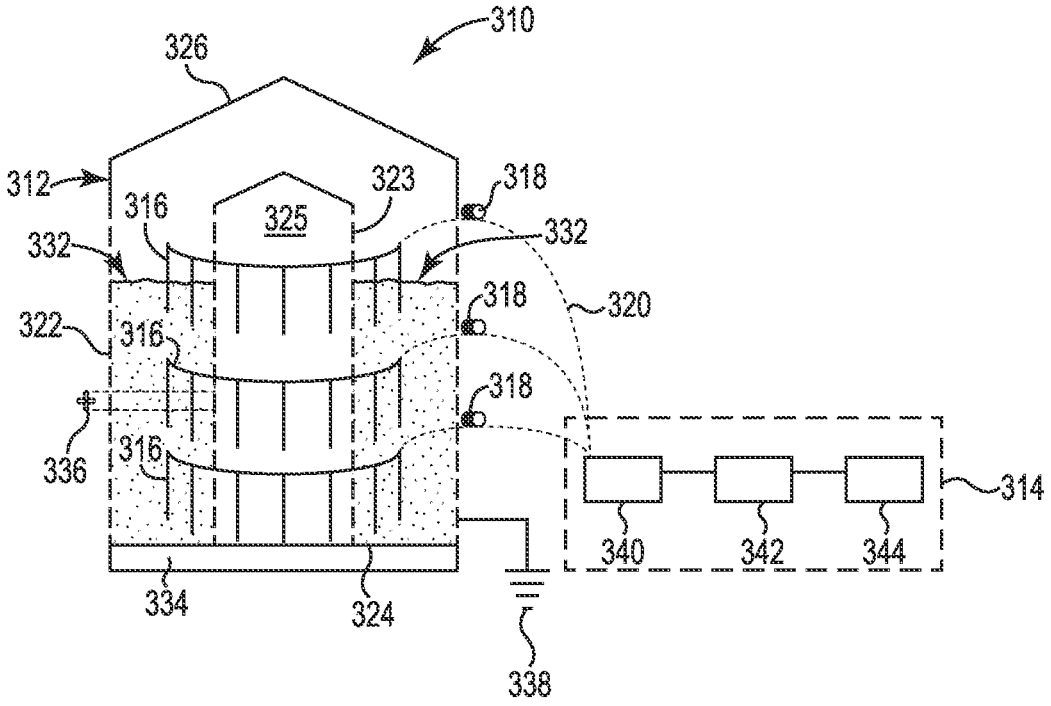
FIG. 7 is a cross-sectional view of a material drying system in accordance with one embodiment.

FIG. 7 illustrates a material drying system 310 in accordance with one embodiment. Material drying system 310 includes bin 312, generator and controller 314, metal conductive shapes 316 and conductive shape controllers 318. Generator and controller 314 is coupled to metal conductive shapes 316 and conductive shape controllers 318 via transmission line 320. Generator and controller 314 includes frequency generator 340, main control module 342, and power source 344.

In one embodiment, bin 312 includes generally cylindrical walls 322 and has a bottom 324 and a top 326. As illustrated, cylindrical walls 322 of bin 312 are perforated, which allows the passage of air out of bin 312. Bin 312 is further configured with inner cavity walls 323, which are also generally cylindrical walls that are perforated. Accordingly, inner cavity walls 323 establish inner cavity 325 into which force air can be introduced, as will be discussed further below. Metal conductive shapes 316 are be provided distributed about inner cavity walls 323 within harvested material 332. In one embodiment, bin 312 is made completely of metal and is configured to rest on a secure foundation 334, such as a concrete slab. Bin 312 may be further electrically coupled to earth ground 338.

Similar to bins 12 and 212 described above, bin 312 is in various embodiments configured to dry a variety of harvested material 332, which may be corn, rice, grains, soybeans, nuts or other harvested plant material. In operation, bin 312 is filled with harvested material 332 between inner cavity walls 323 and cylindrical walls 322. In one embodiment, bin 312 is configured as a continuous-fill bin in that, rather than storing harvested material 332 after it is dried, a mechanical sweep (such as mechanical sweep 240 illustrated in FIG. 6 and described above) is configured to remove the dried harvested material 332 out of bin 312. As such, harvested material 332 can be loaded into bin 312, dried, and then removed in order to make room for additional material that can be added in continuous fashion.

In one embodiment, conductive shapes 316 are mounted between inner cavity walls 323 and cylindrical walls 322 such that they are distributed throughout harvested material 332 that is added to bin 312. In the illustrated embodiment, conductive shapes 316 are plurality of vertically oriented rods separated from each other and forming a cylindrical ring. Generator and controller 314 transfers RF energy to the conductive shapes 316 via transmission line 320. Once energized, conductive shapes 316 and bin 312 form an effective system capacitor for system 310, with the metal of bin 312 forming one side of the capacitor, the metal of conductive shapes 316 forming another side of the capacitor, and the harvested material 332 forming the dielectric material therebetween. This effective system capacitor quickens drying and increases overall energy efficiency in drying.

In one embodiment, as with the systems 10 and 210 described above, conductive shape controller 318 includes adjustable capacitors and/or inductors that are controlled by main control module 342 that can be adjusted based on the measured feedback received from sensors (for example, sensors 50 illustrated in FIG. 2). In one example, an adjustable capacitor or an adjustable inductor on conductive shape controller 318 is tuned to achieve resonant conditions relative to bin 312, conductive shapes 316, and harvested material 332. Since the moisture content of harvested material 332 varies, the capacitance of the system capacitor formed from bin 312, conductive shapes 316, and harvested material 332 varies accordingly. Main control module 342 and conductive shape controller 318 electronically adjust the adjustable capacitor or adjustable inductor on conductive shape controller 318 to account for the level of moisture in harvested material 332 and its effect on capacitance.

As such, capacitance and inductance is matched in order to achieve resonance. At resonance, material drying system 310 provides resonant, efficient energy to conductive shapes 316, which act as a capacitive object with bin 312 inducing dielectric movement of the water molecules in harvested material 332 and on the surface of the harvested material 332. This activity increases the rate of evaporation from the surface and increases the water diffusion rate from the center to the surface of harvested material 332.

Figure 8:
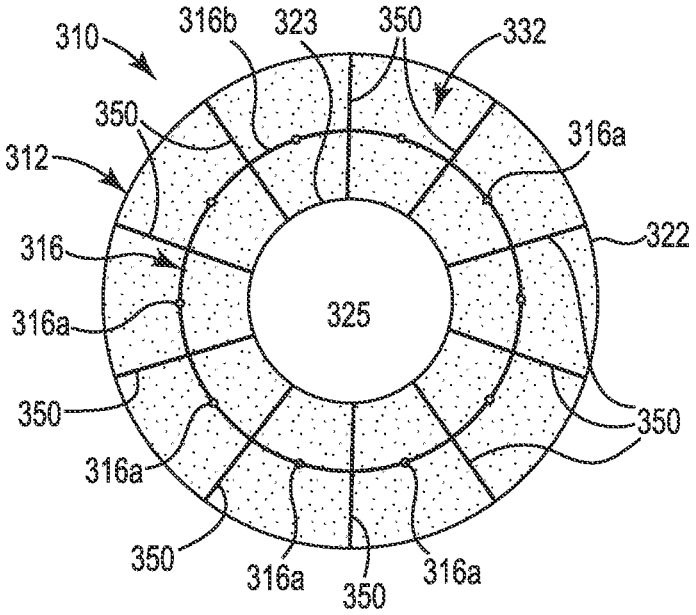
FIG. 8 is a top view of a material drying system in accordance with one embodiment.

In one embodiment, conductive shapes 316 are plurality of vertically oriented rods separated from each other, and in one example, forming a cylindrical ring. FIG. 8 illustrates one embodiment of material drying system 310 in a top view, looking down into bin 312. In the embodiment, bin 312 further includes internal wall sections 350 that run up and down the entire height of bin 312 in one embodiment. Each "pie-shaped" section formed by wall sections 350 have a rod **316*a* (not all rods are labeled to simplify the figure) mounted with the section that is electrically coupled to the other rods 316*a* via electrical connection 316*b*, the rods 316*a* couple with electrical connection 316*b* together forming conductive shapes 316**.

In one embodiment, each of the rods **316*a* of conductive shapes 316 are limited in length, for example, having a length of approximately 24 to 30 inches. As with conductive shapes 16 and 216 above, each of the plurality of metal rods 316*a* are discrete sets of shapes that can be distributed about the interior of bin 312. In this way, each of the plurality of rods 316*a* can be configured to affect different areas of harvested material 332 contained within bin 312. For example, in one embodiment, one set of rods 316*a* coupled together with electrical connection 316*b* forming conductive shapes 316 is supplied for every five to seven feet of height in bin 312**.

As such, where moisture content varies throughout harvested material 332 in bin 232, main control module 342 and conductive shape controller 318 can tune capacitance or inductance based on the sensed measurements that were taken via a sensor that is adjacent to a particular conductive shape 316. In this way, capacitance or inductance at conductive shape controller 318 associated with shape 316 can have a custom adjustment based on moisture content and other measured conditions, in order to obtain and maintain resonance. For example, a lower first layer of harvested material 332, for example, five feet, may have a lower moisture content from having been dried for a period of time before a second layer on top of the first layer is added with a higher moisture content. A first conductive shape 316 (for example, plurality of metal rods **316*a*) can be tuned for drying the first layer and a second conductive shape 316 (for example, plurality of metal rods 316*a***) can be tuned for drying the second layer.

Figure 9:
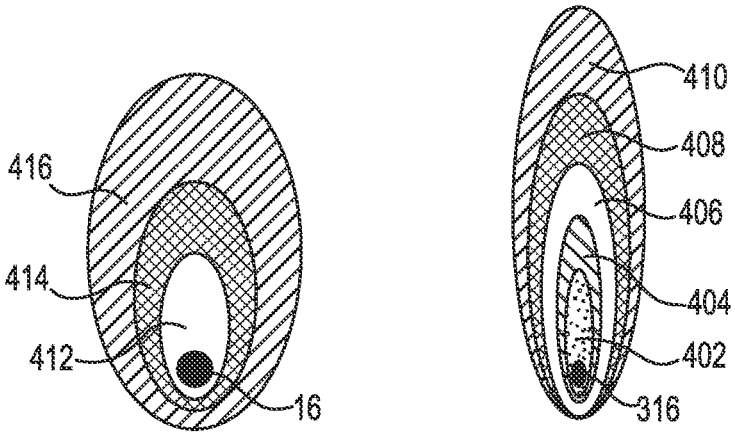
FIG. 9 illustrates energy dissipation from conductive shapes in accordance with one embodiment.

The distributed nature of conductive shapes 16/216/316 allows for drying systems 10/210/310 to dry portions of harvested material within the bins in accordance with some embodiments. FIG. 9, for example, illustrates drying zones attributable to conductive shape 16 (on the left) and conductive shape 316 (on the right). As shapes 16 and 316 are energized with RF energy, the energy is dissipated from the shapes in generally radial patterns outward. In the illustrated example, warm air was blown into the bins (for example, fan 36 or fan 336 delivered forced air as described above) such that radial zone patterns are oval shaped. Without the delivered forced air, the zone patterns would be more circular shaped.

In the example illustrated in FIG. 9, conductive shapes 16 and 316 were energized in corn as the harvested material, which was filled into the respective bins. Temperature was recorded before RF energy was delivered so that the increase in temperature could be measured for the corn in the illustrated drying zones. For conductive shape 16, zones 412, 414 and 416 respectively measured increase temperatures of 40, 20 and 10 degrees Fahrenheit. For conductive shape 316, zones 402, 404, 406, 408 and 410 respectively measured increase temperatures of 80, 60, 40, 20 and 10 degrees Fahrenheit.

As illustrated, the effect of the RF energy dissipates as a large distance is reached relative to the conductive shape. By positioning conductive shapes 16/216/316 relative to each other with a large bin, however, energy efficiency in drying is achieved. For example, if zone 412 is an inner band representing the largest increase in temperature and zone 416 is an outer band representing the smallest increase in temperature due to a first conductive shape 16, a second conductive shape 16 can be relatively positioned to the first, such that its outer band either approaches or even intersects the outer band of the first conductive shape 16. In this way, the system dries the harvested material in a way that is energy efficient.

In one example, drying system 10/210/310 has 2000 watts of energy delivered to conductive shapes 16/216/316 to dry harvested corn in approximately three to six days. At that energy level, it has been found that, since about 1 watt of energy can efficiently dry about 1 bushel of corn, 2000 watts of energy can efficiently dry about 2000 bushels of corn. In a bin 12/212/312 that is 20 feet in diameter, this equates with approximately seven feet of corn. As such, conductive shapes 16/216/316 are provided for every seven feet of corn. If the 20-foot diameter bin is approximately 21 feet in height, 3 sets of conductive shapes 16/216/316 can be provided—one for each seven-foot layer of corn within the 21 foot height. Alternatively, one set of conductive shapes 16/216/316 can be used to dry each seven-foot layer, then either the layer of corn or the conductive shapes can be moved for drying another layer.

In one embodiment, systems 10, 210 and 310 control the RF energy from the frequency generator such that no standing wave is established in the harvested material. In embodiments where the waveform of RF energy has a frequency in the range of 10 M Hz to 50 M Hz, the size of conductive shapes 16/216/316 is limited to prevent a standing wave from establishing in any of the shapes. For example, the metallic orbs used as conductive shapes are limited to 12 inch diameters in one embodiment. Also in one example, the metallic cylindrical rings used as conductive shapes are limited in height to no more than 12 inches. In another example, the length of the plurality of rods used as conductive shapes is limited in length to no more than 2 feet in length and one inch in diameter. By limiting the size of the conductive shapes, systems 10/210/310 can ensure that no standing wave is established, and the efficiency of system 10/200/300 is maintained.

In various embodiments, conductive shapes 16/216/316 are variously located relative to the harvested material in the bin. For example, in the illustration of FIG. 1, conductive shapes 16 are all illustrated within harvested material 32. In FIG. 2, however, bin 12 is only partially filled such that although some of the conductive shapes 16 are illustrated within harvested material 32, at least some of conductive shapes 16 are outside or above harvested material 32. Even these conductive shapes above the harvested material 32, however, are capable of receiving and transmitting the RF energy that is used in the drying of harvested material 32.

Furthermore, although orbs, cylindrical rings and rods are illustrated distributed within and over the harvested material, other shapes are possible as well in establishing the system capacitor using the bin walls, the conductive shapes and the harvested material therebetween. Also, various combinations of these various shapes can be combined and used together in various embodiments. For example, rather than orbs being used in the illustration of FIG. 2, horizontal or vertical rods could be used within the harvested material as conductive shapes 16. In addition, some orbs and some rods could be used, for example, orbs in lower layers and rods in upper layers, or vice versa.

In addition, although bins 12/212/312 are illustrated as cylindrical, other shapes are also possible for the bins, such as rectangles and other shapes. The bins, however, are conductive and configured to hold significant volumes of harvested materials. The bins are typically galvanized steel, sheet metal or otherwise conductive and sturdy material, but could also be a metal fabric. The bins are configured to fully contain the RF energy that is transmitted to the conductive shapes that are located within the bins. RF energy is not typically safe for living animals, and as such, it is important that the energy is contained within the metal bin.

Furthermore, in certain embodiments, small living creatures that are in the bins when the RF energy is being transmitted will tend to be driven out or tend not to survive being subjected to significant levels of RF energy for an extended period of time. Accordingly, drying systems 10/210/310 have the added advantage of driving our or killing pests, which are undesirable within harvested materials.

Material drying systems 10/210/310 are more efficient than conventional grain drying systems. Because drying systems 10/210/310 are configured, through the use of RF energy, to heat the kernel of the harvested material itself, rather than heating the surrounding air (thereby using hot air to dry the material), the systems will result in 50-75% less energy use than conventional systems. Material drying systems 10/210/310 use reduced energy by achieving resonance in the harvested materials, such that once the molecules are spinning at very high rates, resonance is used to keep the spinning going with little use of additional energy. The RF energy then also reduces the surface tension of the moisture, allowing for easier evaporation.

Accordingly, less heat is required in material drying systems 10/210/310 than in conventional systems. With conventional grain drying systems air is heated to over 200 degrees Fahrenheit and forced through the material such that it is common for the material itself to reach temperatures of over 180 degrees Fahrenheit for periods of time up to half an hour or more.

Material drying systems 10/210/310, by using RF energy to excite the harvested materials, avoid such heating. This both saves energy and better preserves the harvested material. In embodiments of material drying systems 10/210/310, RF energy is used such that the harvested material never reaches above 130 degrees Fahrenheit, even where heated air is used to assist in the drying process. In one example of an in-bin application, grain was dried in a material drying system such as system 10 above while the temperature of the harvested material 32 was monitored. At no point did harvested material 32 ever reach above 80 degrees Fahrenheit and generally ranged from 60 to 80 degrees Fahrenheit.

In a similar example, grain was dried in a continuous-flow application in a material drying system, such as system 310 above, while the temperature of the harvested material 332 was monitored. At no point did harvested material 32 ever reach above 130 degrees Fahrenheit and generally ranged from 75 to 112 degrees Fahrenheit.

Since nutrients and proteins in many harvested materials are adversely affected at temperatures above 140 degrees Fahrenheit, material drying systems 10/210/310 have the added benefit of shortening drying time of the harvested materials without ever having to raise the temperature of the harvested materials above 140 degrees Fahrenheit, as in conventional drying systems. As a result, harvested materials dried in material drying systems 10/210/310 are a better quality end product with nutrients and proteins of harvested materials preserved and unaffected, then when dried in conventional systems where nutrients and proteins are adversely affected.

Furthermore, material drying systems 10/210/310 also tend to preserve, or even slightly enhance, germination of harvested materials relative to conventional drying methods. In one example, harvested materials (corn kernels in this case) were dried with RF energy and compared against harvested materials (corn kernels) dried in conventional systems using warmed air. The plant characteristics for sprouting and growing of each were then tested and recorded. After being dried, the corn kernels were wetted and allowed to sit for approximately a week. Observations of how many kernels sprouted indicated that a significantly higher percentage of the corn kernels dries with RF energy sprouted than did those dried with just conventional warmed air. Harvested materials dried with material drying systems 10/210/310 tend to have enhanced germination.

In addition, material drying systems 10/210/310 also tends to decrease mold within certain harvested materials. Since some harvested materials tend to develop mold when stored for a period of time with high moisture content, material drying systems 10/210/310, by using RF energy to excite the harvested materials, drives down mold in the harvested materials, in addition to drying the material. Harvested material that has been dried using material drying systems 10/210/310 tend to have less mold growth than materials that are dried using conventional drying systems, such as using warmed air without RF energy.

In one embodiment, material drying systems 10/210/310 were used to dry frozen harvested material. Since material drying systems 10/210/310 configured, through the use of RF energy, to heat the kernel of the harvested material itself from the inside, rather than heating the surrounding air, it is possible for material drying systems 10/210/310 to dry material that enters the bins below 32 degrees Fahrenheit.

In one experiment, material drying systems 10 was used and 5,000 bushels of corn was the harvested material 32 that was placed in bin 12 at nearly 0 degrees and no warmed air was used. Conductive shapes 16 were energized with RF energy and only a small portion of the corn (about 5 bushels) near conductive shape 16 warmed to temperatures above freezing. Yet, the final moisture content of the sample indicated the corn dried from 18% moisture content to 10.35% moisture content.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A material drying system comprising:

a conductive bin at least partially filled with harvested material;

a frequency generator configured to generate radio frequency energy;

a controller coupled to the frequency generator for controlling the radio frequency energy; and at least one conductive shape located within the harvested material and coupled to the frequency generator and controller;

characterized in that the frequency generator and controller provide the radio frequency energy to the at least one conductive shape such that a system capacitor is formed by the combination of the at least one conductive shape and the conductive bin and with the harvested material forming a dielectric therebetween such that friction of water molecules in the harvested material is induced quickening drying thereof.

2. The material drying system of claim 1, wherein the bin is generally cylindrical-shaped and configured to fully enclose all radio frequency energy is substantially contained within the bin, and the bin is coupled to earth ground.

3. The material drying system of claim 1, further comprising a conductive shape controller including an adjustable capacitor and adjustable inductor such one of the adjustable capacitor and adjustable inductor is adjusted to match the capacitance or impedance of the system capacitor thereby substantially approaching resonance.

4. The material drying system of claim 3, further comprising a sensor configured to sense parameters of the harvested material proximate to the at least one conductive shape, wherein one of the adjustable capacitor and adjustable inductor is adjusted based on the sensed parameter.

5. The material drying system of claim 4, wherein the sensed parameters include temperature and humidity of the harvested material.

6. The material drying system of claim 1, wherein the controller is configured to control the frequency generator to avoid standing waves in the harvested material.

7. The material drying system of claim 1, wherein the controller monitors RF reflection and adjusts capacitance in order to maintain resonance and increase energy efficiency.

8. The material drying system of claim 1, wherein the at least one conductive shape is one of a spherical orb, a cylindrical ring and a plurality of rods configured in a ring.

9. The material drying system of claim 1, wherein a plurality of conductive shapes are distributed throughout the harvested material within the bin such that each of the plurality of conductive shapes are configured to warm different sections of the harvested materials.

10. The material drying system of claim 1, wherein the conductive bin is configured as a continuous-flow bin having inner perforated walls and outer perforated walls such that forced air flow from an inner cavity formed by the inner walls can flow from the inner cavity through the harvested material and out of the bin, wherein the bin maintains a barrier to prevent RF energy from leaking out of the bin.

11. The material drying system of claim 1, wherein the radio frequency energy penetrates the harvested material within the bin decreasing mold in the harvested material and decreasing living creatures within the bin.

12. The material drying system of claim 1, wherein the frequency generator is configured to generate continuous sinusoidal waves between 10 M Hz to 50 M Hz and from 2,000 to 20,000 watts.

* * * * *